US006186339B1

(12) United States Patent
Saltsov et al.

(10) Patent No.: US 6,186,339 B1
(45) Date of Patent: Feb. 13, 2001

(54) COMBINATION BILL ACCEPTING AND BILL DISPENSING DEVICE

(75) Inventors: Leon Saltsov, Thornhill; Sergiy Bukhman, Toronto, both of (CA); Oleksandr Onipchenko, Kiev (UA)

(73) Assignee: Cashcode Company, Concord ( * ) Notice: Under 35 U.S.C. 154(b), the term of this patent shall be extended for 0 days.

(21) Appl. No.: 09/275,970

(22) Filed: Mar. 25, 1999

(51) Int. Cl.[7] ..... B07C 5/00; B65H 39/10

(52) U.S. Cl. ..... 209/534; 271/302; 271/303

(58) Field of Search ..... 209/534; 271/302, 271/279, 298, 303, 207, 216, 306

(56) References Cited

U.S. PATENT DOCUMENTS

| | | | | |
|---|---|---|---|---|
| 4,249,552 | * | 2/1981 | Margolin et al. | 133/1 |
| 4,337,864 | * | 7/1982 | McLean | 209/534 |
| 4,343,582 | * | 8/1982 | Lundbald et al. | 414/32 |
| 4,972,958 | * | 11/1990 | Ito et al. | 209/534 |
| 5,064,074 | * | 11/1991 | Edin et al. | 271/302 |
| 5,135,212 | * | 8/1992 | Utsumi et al. | 209/534 |
| 5,205,551 | * | 4/1993 | Nagano et al. | 271/225 |
| 5,533,627 | * | 7/1996 | Nordqvist | 209/534 |
| 5,680,935 | * | 10/1997 | Mistander et al. | 209/534 |
| 5,868,387 | * | 2/1999 | Kida et al. | 271/304 |
| 5,918,748 | * | 7/1999 | Clark et al. | 209/534 |
| 5,975,273 | * | 11/1999 | Zwahlen et al. | 194/206 |
| 6,006,989 | * | 12/1999 | Ademmer et al. | 209/534 |

FOREIGN PATENT DOCUMENTS

| | | | | |
|---|---|---|---|---|
| 197 36 453 | | 2/1999 | (DE) . | |
| 0 113 326 | | 11/1984 | (EP) . | |
| 0182137 | * | 5/1986 | (EP) | G07D/1/100 |
| 0 199 253 | | 10/1986 | (EP) . | |
| 0236561 | * | 9/1987 | (EP) | 271/207 |
| 0 290 731 | | 11/1988 | (EP) . | |
| 2197300 | * | 5/1988 | (GB) | B65H/1/100 |
| 0036852 | * | 3/1983 | (JP) | 271/207 |

* cited by examiner

*Primary Examiner*—Katherine A. Matecki
*Assistant Examiner*—Daniel K Schlak

(57) ABSTRACT

A device for processing accepted banknotes uses a processing junction with banknote accumulators arranged on either side thereof and a banknote vault or stacker located at one end of the processing junction. A banknote dispensing outlet is associated with the banknote accumulators for receiving previously accumulated banknotes which are dispensed through the outlet.

16 Claims, 8 Drawing Sheets

6
4
2
200
6a
1
41
22
14
6b
40
12
10
20
11
30
6c

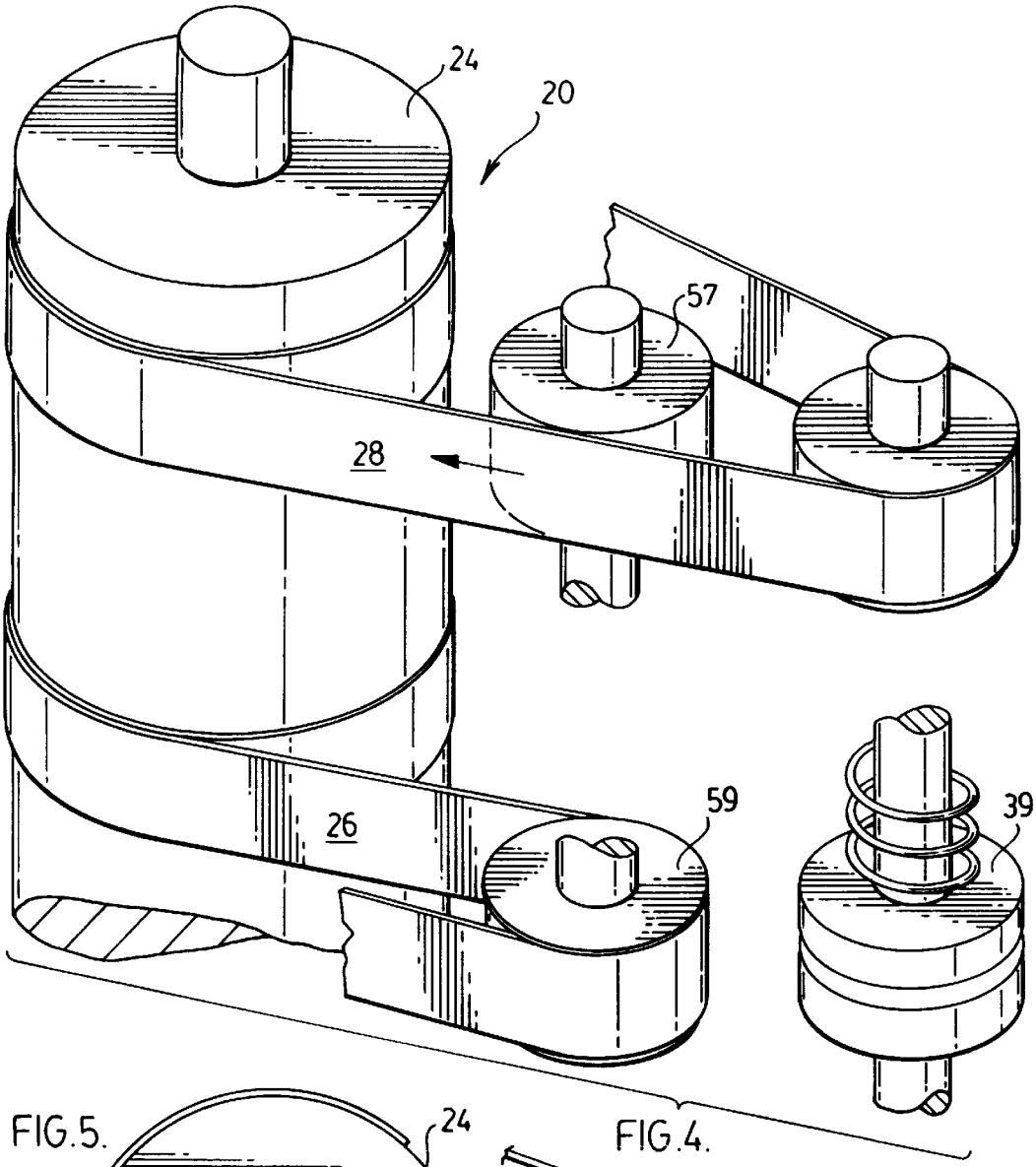
FIG.4.
FIG.5.
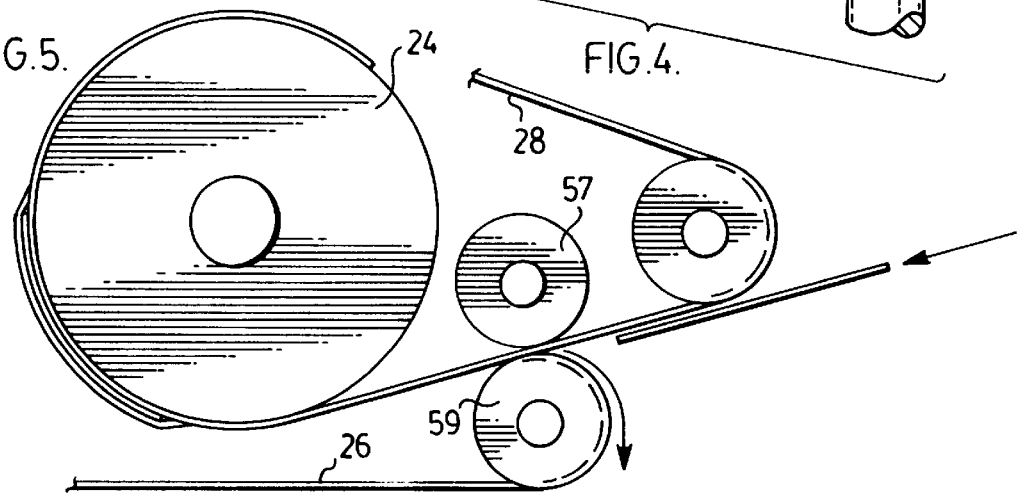

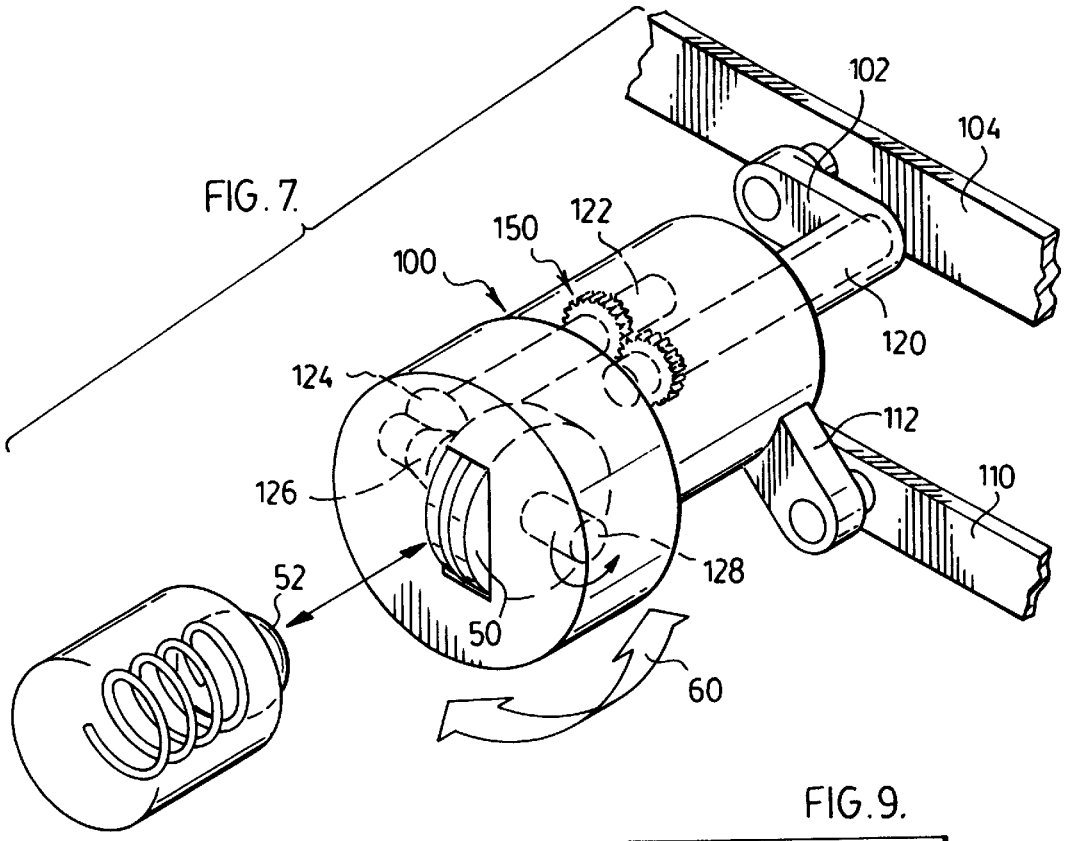
FIG. 8.
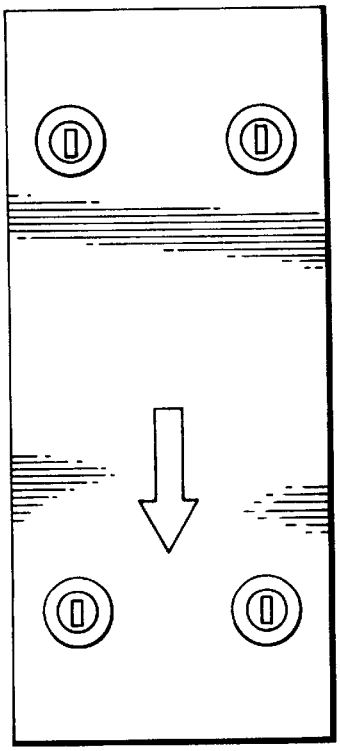
FIG. 9.
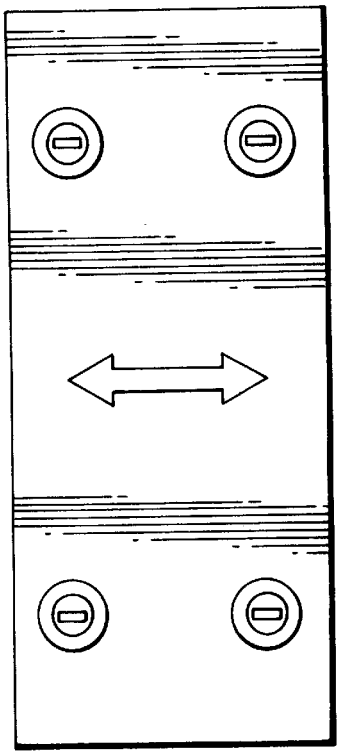

COMBINATION BILL ACCEPTING AND BILL DISPENSING DEVICE

FIELD OF THE INVENTION

The invention relates to devices for accepting of bills and accumulating bills in a manner to allow dispensing of selected bills.

BACKGROUND OF THE INVENTION

There are known validators devices for bills or other paper means of payment which devices store the accepted bills in a removable cassette or process accepted bills for temporary storage and subsequent dispensing. It is desirable to store as many bills as possible in a storage arrangement for subsequent dispensing. The stored bills are all of the same value and are typically wound on a drum in a serial manner. This serial manner accommodates dispensing of bills, one bill at a time.

It is desirable to make these devices as adaptable for different currencies as possible. This general adaptation of the device is made more difficult due to different sizes of banknotes from currency to currency and from denomination to denomination.

The present invention enables bills of different values and size to be accepted and appropriately processed. The arrangement has the capability of storing for subsequent dispensing, two different banknote denominations. In addition, the device has a stacking cassette for receiving and storing of bills that are not to be subsequently dispensed.

SUMMARY OF THE INVENTION

A device for validating and accepting paper currency comprises a validator that evaluates selected properties of the paper currency and determines whether the paper currency should be accepted or rejected. The validator rejects the paper currency if it is determined that paper currency is not acceptable.

The validator has associated therewith a bill processing junction into which accepted paper currency is fed one bill at a time. The processing junction includes at least three processing paths including first and second paths for accumulating paper currency for later dispensing and a third path for storage of accepted paper currency. The device includes a drive arrangement associated with the processing junction for selectively driving an accepted bill along any of said three paths.

According to an aspect of the invention the processing junction longitudinally receives accepted paper currency and the first and second paths for accumulating paper currency cause the paper currency to move in a direction transverse to the longitudinal direction of the accepted paper currency.

According to yet a further aspect of the invention, the third path moves the currency in a direction parallel to the longitudinal direction of the accepted currency and stores the currency in a removable stacking arrangement.

According to yet a further aspect of the invention, the third dispensing path is located on a side of said processing junction opposite an inlet path to the processing junction.

According to yet a further aspect of the invention, the device includes an accumulator and dispensing unit associated with each of the first and second paths and the accumulator and dispensing units have a common dispensing outlet through which accumulated paper currency can be dispensed.

According to yet a further aspect of the invention, the common dispensing outlet accumulates bills to be dispensed and dispenses accumulated bills as a stack of bills.

According to yet a further aspect of the invention, the processing junction includes a drive arrangement which is movable for driving a received paper currency along any of said three paths.

According to yet a further aspect of the invention, the drive arrangement includes drive rollers on either side of a longitudinal center line of the processing junction and the drive rollers are rotatable from a first orientation for moving a bill longitudinally in said junction to a second orientation for moving said bill transversely in said junction along either of said first and second paths.

According to yet a further aspect of the invention, each dispensing arrangement serially receives the paper currency and winds said paper currency transversely onto a cylinder drum, and each drum includes flexible separating tapes located either side of a received paper currency with said tape also being wound on said respective drum.

According to yet a further aspect of the invention, the tapes are spaced along the length of said respective drum to be non overlapping with adjacent tapes.

BRIEF DESCRIPTION OF THE DRAWINGS

Preferred embodiments of the invention are shown in the drawings, wherein:

FIG. 4 is a partial perspective view showing the separating tapes wound on the drum and in position to receive an accepted banknote therebetween;

FIG. 5 is a view similar to FIG. 4 showing a banknote being received and about to be processed between two tapes;

FIG. 7 is a partial perspective view showing one of the drive roll arrangements;

FIG. 8 shows the drive roll arrangements of the processing junction arranged for longitudinal movement of a received banknote;

FIG. 9 shows the drive rollers positioned for transverse or lateral movement within the processing junction.

DETAILED DESCRIPTION OF THE PREFERRED EMBODIMENTS

Figure 1:
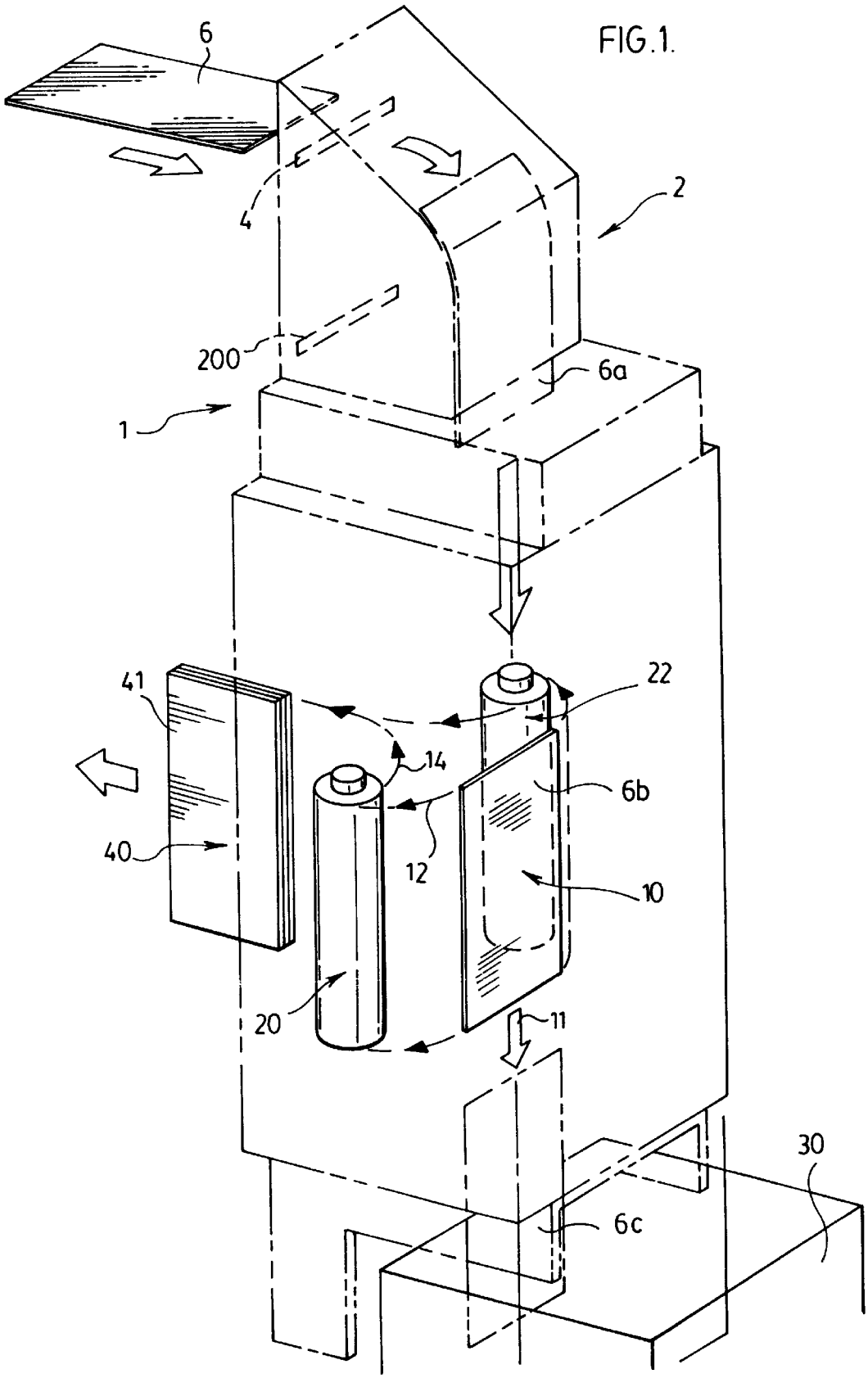
FIG. 1 is a partial perspective view showing the general components of the device and the possible processing paths for accepted paper currency.

The bill processing device 1 of FIG. 1 includes a validator 2 having an inlet 4 into which a bill 6 is to be inserted. The bill 6 is used in this application as representative of any paper currency, banknote or other form of payment involving the exchange of paper substrates.

The validator 2 performs various tests on a received bill and assuming the bill is accepted, it passes the accepted bill 6*a* to the processing junction 10. The processing junction 10 has a first bill accumulator 20 located to one side of the processing junction and a second bill accumulator 22 located to the opposite side of the processing junction. If the accepted banknote 6*b*, situated in the processing junction 10, is to be accumulated for later dispensing, it will be moved laterally to either the first accumulator 20 or the second accumulator 22. Each accumulator typically accumulates bills of the same denomination. For example, accumulator 20 could be dedicated to accumulating $5 bills and accumulator 22 could be dedicated to accumulating $1 bills. Thus, all the bills wound on one of the accumulators will be of the same denomination. The validator has previously determined the denomination of the bill. Depending upon the particular application, the denomination of the bills wound onto each accumulator will be different, although there may be applications where both accumulators store the same denomination. This would provide additional capacity.

The processing junction 10 also provides a path for moving of a banknote in the direction of arrow 11 for receipt of the bill 6*c* in the bill storage cassette 30. These bills are stacked within the banknote cassette and are not available for subsequent dispensing. The processing junction 10, and in particular the accumulators 20 and 22, store bills for later dispensing. Accumulated bills are dispensed by driving the accumulators in the opposite direction and allowing dispensing of bills along the path indicated by arrow 14. Bills to be dispensed are accumulated in a stack and dispensed as a group 41 through a common outlet for stacked bills indicated as 40. This stack 41 of banknotes can be bills from one accumulator or a mixture of bills from the accumulators 20 and 22.

It should be noted with reference to FIG. 1, that the banknotes are accumulated with their longitudinal axis aligned with the longitudinal axis of the cylinder on which they are rolled. This orientation of the banknotes allows more banknotes to be rolled onto the cylinder as each accumulated bill is not rolled in the longitudinal direction. This also has the additional benefit of reducing the extent of the curl which is imparted to the banknote during its storage on the cylinder. The diameter of the accumulator continues to increase as more bills are stored, and there is a size limitation based on the physical size of the device. The lateral winding increases the number of bills that can be stored. The tapes include markings such as a metal band that is detected and used to generate a signal to stop any additional storage of bills on that accumulator. Any further bills are transported to the storage cassette. The lateral storage of a bill on the accumulator reduces the space required to store bills on a given diameter cylinder and is more efficient relative to longitudinal winding of the bills on the same size cylinder.

Figure 2:
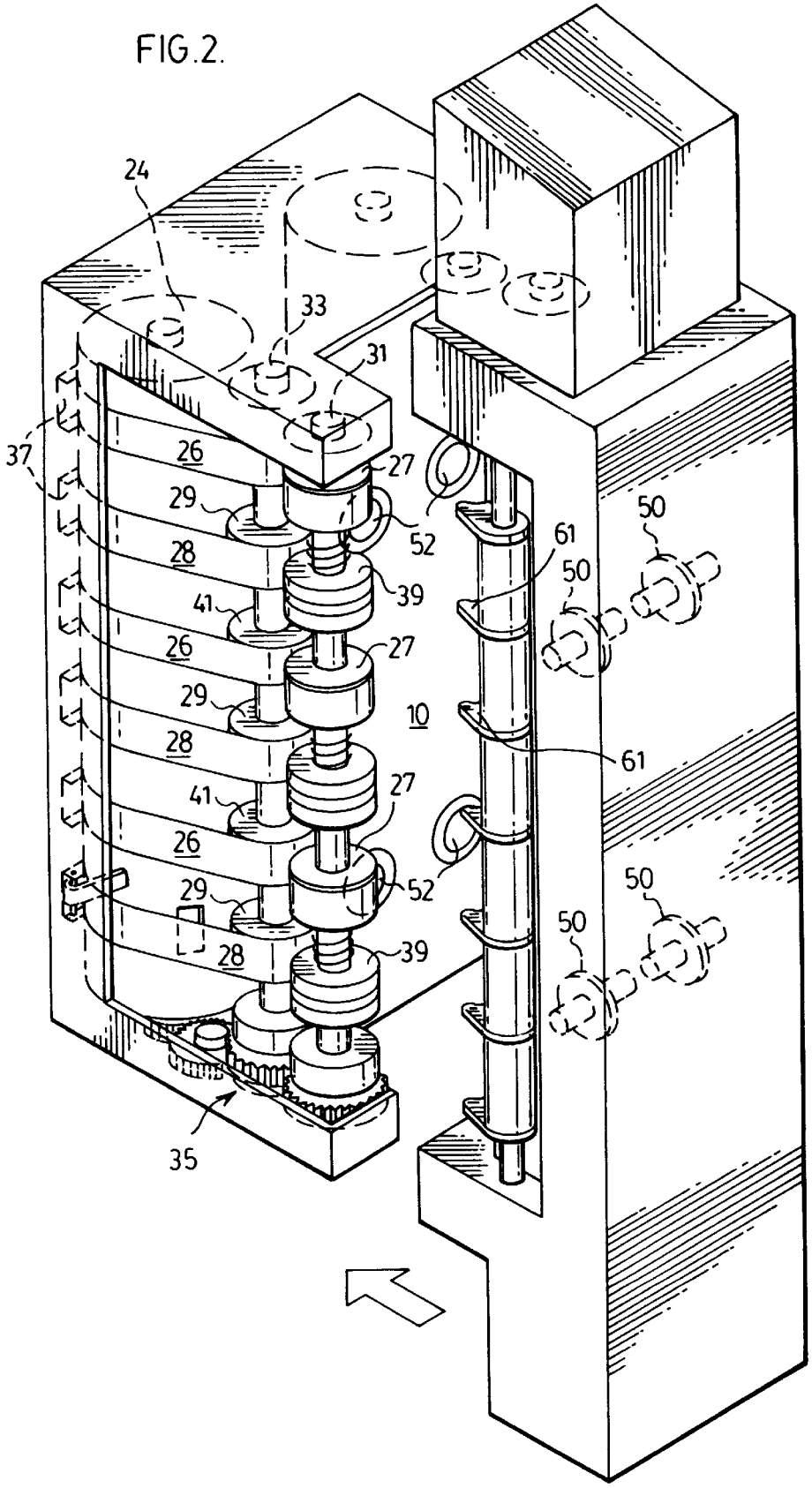
FIG. 2 is a partial perspective view showing the paper currency dispensing units and currency separating tapes thereof.
Figure 3:
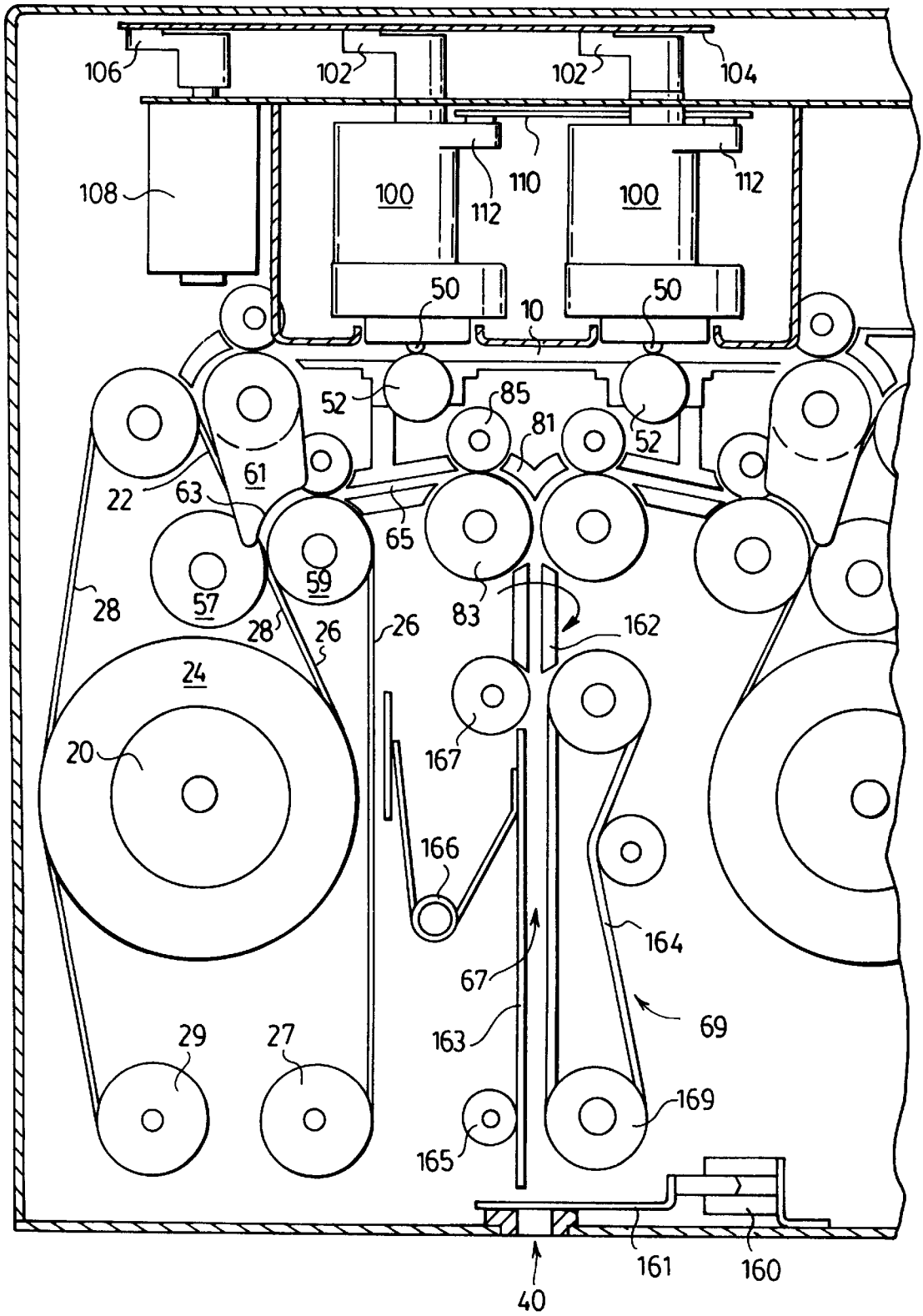
FIG. 3 is a partial sectional view illustrating various components of the system.

FIG. 2 and FIG. 3 show details of the thin pliable film tapes that are used to separate accumulated bills on the accumulating cylinders 24. Magnetic recording type tape can be used. These tapes 26 are positioned to contact the back face of the banknote and tapes 28 are positioned to contact the front face of the banknote located between the banknote and the accumulating cylinder 24. Thus, each banknote is located between tapes 26 and 28. FIG. 2 also illustrates how the tapes are longitudinally spaced in the length of the received banknote and in the length of the longitudinal axis of the accumulating cylinder. The tapes are offset and non-overlapping and increase the thickness required to store a banknote on the cylinder approximately a single thickness of the tape. With this arrangement, the two tapes ensure that banknotes are separated one from the other and are serially wound and serially dispensed from the accumulator 24.

In the drawing of FIG. 2, tapes 26 are wound onto the spools 27 located on shaft 31. Tapes 28 are wound onto spools 29 attached to shaft 33. The tapes of spools 27 and 29 are drawn by the accumulated cylinder as a banknote is wound onto the accumulator cylinder 24. The power for drawing the tape is provided by the cylinder 24 and the spools provide some rotational resistance such that only sufficient tape is unwound as is necessary. In contrast, during dispensing of a banknote, these spools 27 and 29 are over driven by the drive arrangement generally shown as 35 and include a friction type clutch arrangement to allow for slippage. The overdriving of these spools assures that the tapes are wound onto the spools 27 and 29 and any excess tape is accumulated. Each of the tapes 26 and 28 is physically attached to the accumulator cylinder 24 and guides 37 are spring loaded at the back of the accumulating cylinder 24 to maintain the general alignment of the tapes 26 and 28. The drive arrangement 35 also causes rotation of the drive wheels generally shown as 39 on shaft 31 and drive wheels 41 on shaft 33. These are attached to the drive arrangement 35 and rotate with the rotation of the shafts 31 and 33.

The processing junction 10 shown in FIG. 2 also includes repositional drive rollers 50 which are positioned for advancing of a banknote along the longitudinal axis of the processing junction 10. The drive wheels 50 are opposite the spring loaded contact balls 52 on the opposite side of the processing junction 10. The repositional drive rollers 50 are rotatable 90 degrees to allow driving of a banknote laterally into the accumulator 20 or the accumulator 22. The one way finger levers 61 allow feeding of a banknote from the processing junction into the respective accumulator and when the accumulator is rotated in the direction to dispense a stored banknote it causes the banknote to follow a dispensing path 65. This aspect is more clearly understood from a review of FIG. 3.

FIG. 3 shows a slightly different arrangement for accumulating of the tapes 26 and tapes 28. In this case, the spools 26 and 27 have been relocated and the tapes trained around rollers for the appropriate positioning, either side of a banknote. The tape 28 of the left hand accumulator 20 is associated with the processing junction 10 to receive a banknote and move the banknote past the finger lever 61. The banknote is driven by the drive wheels 50 and the banknote will have sufficient width to meet the additional drive wheel arrangement represented by rollers 57 and 59. As can be seen, the tape 28 is between the accumulating cylinder 24 and a banknote and tape 26 is applied to the outside of the banknote. Finger levers 61 are spring loaded and are moved by the banknote to allow the banknote to pass by these levers as it is driven from the processing junction 10 to the accumulating cylinder 24.

When the direction of the accumulating cylinder 24 is reversed, a received and stored banknote on the accumulating cylinder 24 will be unwound from the cylinder and fed between driven wheels 57 and 59. The tapes on the far side of wheels 57 and 59 separate from the banknote. The banknote is redirected by the curved section 63 of lever 61 to move through the slot 65 to the drive wheel 83 and the idler wheel 85. Guide 81 directs the driven banknote to the accumulating arrangement 67.

The banknote is fed through the revolving guide 162 which is located between the drive wheel 83 and the separate drive arrangement 69 of the accumulating arrangement 67. The drive arrangement 69 has two wheels 169 with an endless belt 164 being trained about the wheels. A gap is defined between the plate 163 and the opposed surface of the belt 164. This slot accumulates banknotes to be dispensed.

Plate 163 is forced by spring 166 towards the drive arrangement 69. Idler wheels 165 and 167 are placed opposite the drive wheels 169 of the drive arrangement 69.

Figure 3A:
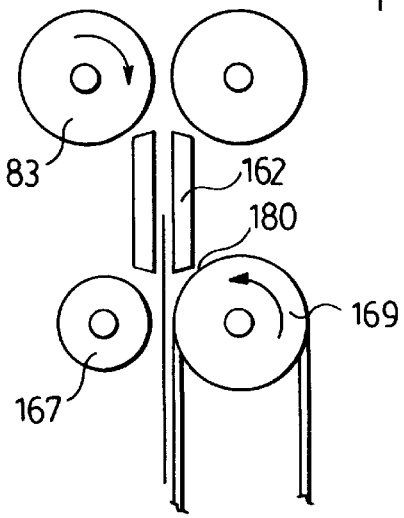
FIGS. 3*a,* 3*b* and 3*c* are illustrative views of an accumulating and dispensing arrangement.

The first banknote 180 shown in FIG. 3*a* has passed the drive wheel 83 and is now being driven by drive wheel 169 and belt 164 into the accumulating arrangement 67. The trailing part of the banknote is still partially received in the revolving guide 162. When the back edge of the banknote appears in the middle of the revolving guide 162, the drive wheel 83 and the drive arrangement 69 stop. The trailing portion of the banknote will still be partially received in the revolving guide 162. The platform 163 is forced by spring 166 towards the drive arrangement 67. Idler wheels 165 and 167 are located opposite the drive wheels 169 of the drive arrangement 69. The advance of the banknote 180 is stopped with the trailing edge of the banknote still partially in the revolving guide 162 as shown in FIG. 3*a*.

Figure 3B:
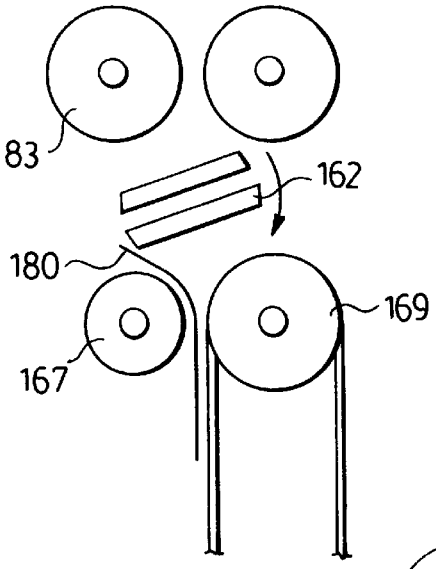
Figure 3C:
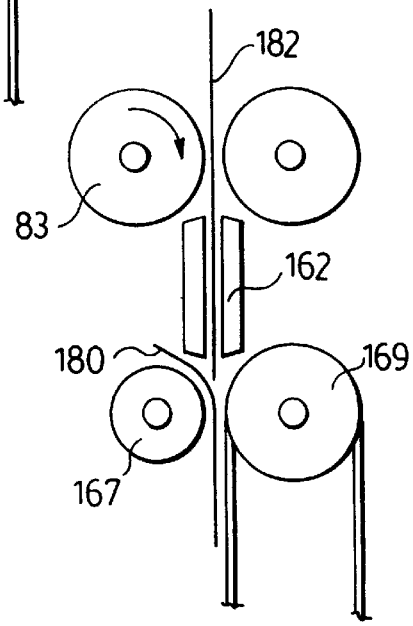

The revolving guide 162 is then rotated 180 degrees. FIG. 3*b* shows the revolving guide 162 partially rotated and the trailing edge of the banknote 180 has been stripped from the guide and is positioned to one side. The guide then assumes the position shown in FIG. 3*c* with the first banknote located in the gap between roller 167 and the revolving guide 162. The next bill 182 can then be fed into the accumulating arrangement 67 as shown in FIG. 3*c*. The back edge of bill 180 has been pulled out of the way and therefore, bill 182 can slide over the face of bill 180. Once this second banknote has been received, revolving guide 162 is then rotated to force both of the trailing edges of banknotes 180 and 182 to the one side of the guide.

In this way, a series of banknotes can be accumulated between the plate 163 and the belt 164. It can also be seen that there is a moveable shutter 161 closing the outlet slot 40. A solenoid 160 allows the shutter to move to a clear position whereby the banknotes can be fed out through the slot 40. The shutter effectively acts as a stop for all of the banknotes and allows the drive arrangement 69 to bring the next banknote into the accumulating arrangement 67. Once the required number of banknotes are collected in the accumulated arrangement 67, solenoid 160 moves the shutter 161 and opens the outlet 40. The drive arrangement 69 is then activated and feeds the accumulated banknotes out of the accumulating arrangement 67 as a group.

Each drive roller 50 of FIG. 3 includes a drive arrangement 100 which have a crank arm 102 connected to a drive link 104 which is driven by crank arm 106 of the drive motor 108. With this arrangement, the drive rollers 50 are synchronized as they are commonly driven by the drive arrangement. Each of the drive arrangements 100 are also rotatable 90 degrees as generally shown in FIGS. 7, 8 and 9. A separate link 110 connects the drive arrangements 100 and is attached to the drive arrangements 100 by crank arms 112. Movement of the link 110 through an appropriate rotation causes the drive wheels 50 to rotate 90 degrees as shown in FIGS. 8 and 9. With this arrangement, the drive wheels 50 pivot on the contact balls 52 and a received banknote trapped between these components. Once the drive wheels 50 are rotated 90 degrees, the drive wheels 50 can be rotated in a first direction for accumulation in accumulator 20 and in a second direction for accumulation in accumulator 22. If the drive wheels are orientated in the direction as indicated in FIG. 3, the received banknote is driven into a stacker 30 located below the processing channel 10.

The link 104 shown in FIG. 7, is attached to the crank arm, 102 which rotates shaft 120. A gear train 150 causes shaft 122 to rotate with rotation of shaft 120. Shaft 122 rotates the bevel gear 124 in contact with the bevel gear 126 on shaft 128 of the drive roller 50. Each drive arrangement 100 can be rotated 90 degrees as indicated by arrow 60 controlled by appropriate movement of the link 110. This movement causes the drive arrangement 100 to move due to the interaction of the crank 112 with the link 110.

Figure 6:
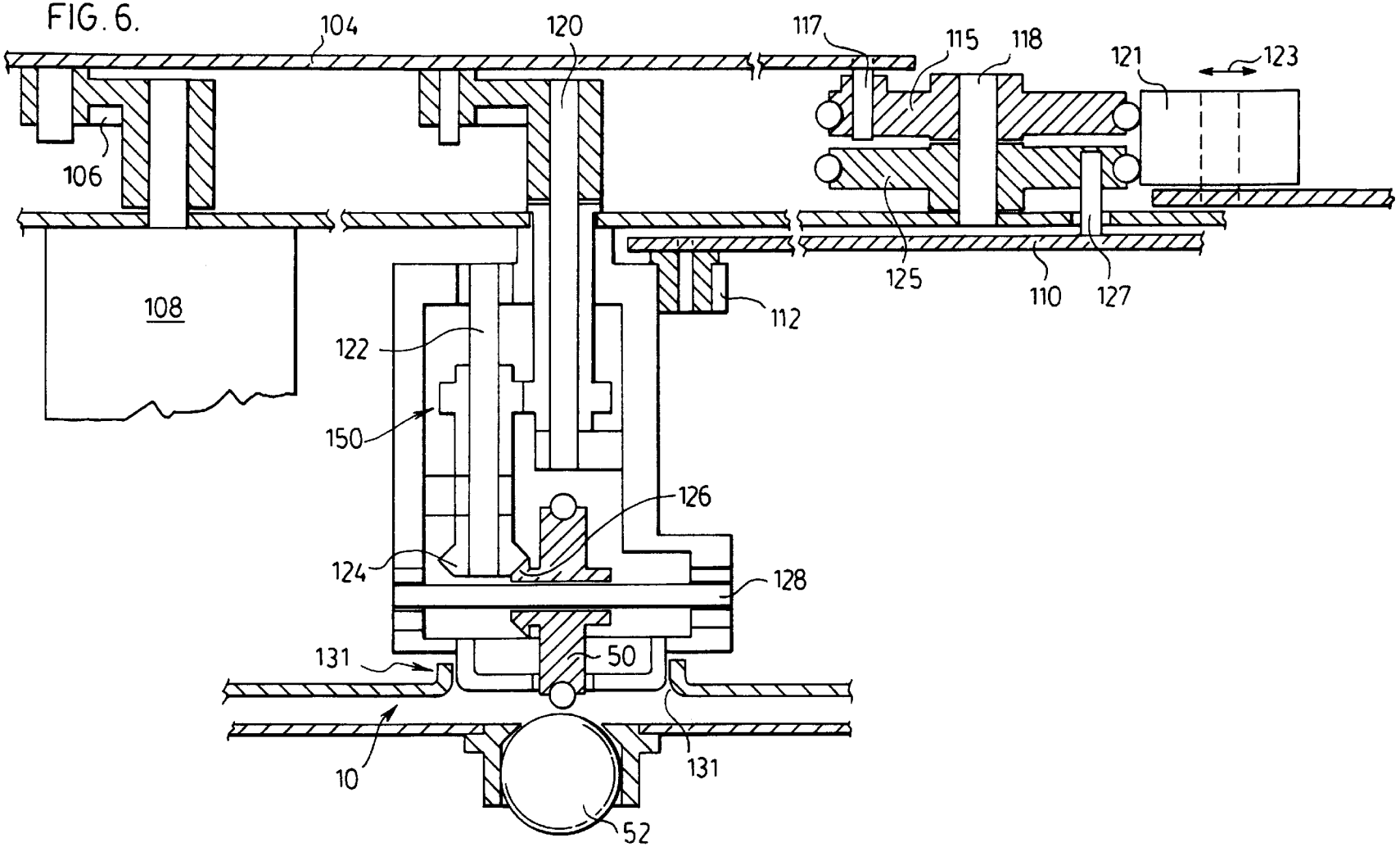
FIG. 6 is a partial sectional view showing a drive arrangement for the drive rollers of the device.

The motor 108, as shown in FIG. 6 via its crank arm 106 and link 104 additionally rotates drive wheel 115 via the pin connection 117. Roller 121 moves as indication by arrow 123 from the drive position shown to a non drive position. In the drive position, roller 121 is driven by drive wheel 115 and in turn, drives wheel 125. Drive wheel 125 is connected by pin 127 to link 110 and causes movement thereof. Wheel 125 basically freely rotates on the shaft 118. With member 121 in a non drive position, (not in contact with drive wheel 115), then link 110 is essentially fixed in position. When wheel 121 is in the drive position, link 110 can be driven to rotate the drive arrangements 100 about their drive shaft 120 and about the bearing generally indicated as 131 in the processing junction 10.

With this arrangement, each of the drive arrangements 100 drive a drive wheel 50 at a common rate and with a common position controlled by drive linkages. These linkages are preferrably a parallelogram type linkage, such that the four drive wheels 50 are driven by the common motor 108. Synchronization of the drive wheels is maintained due to the common motor and repositioning is easily accomplished for driving of the banknote laterally into the accumulators and subsequently reversed for receiving a banknote in the processing junction or moving a banknote through the junction to a stacking arrangement as described.

Figure 10:
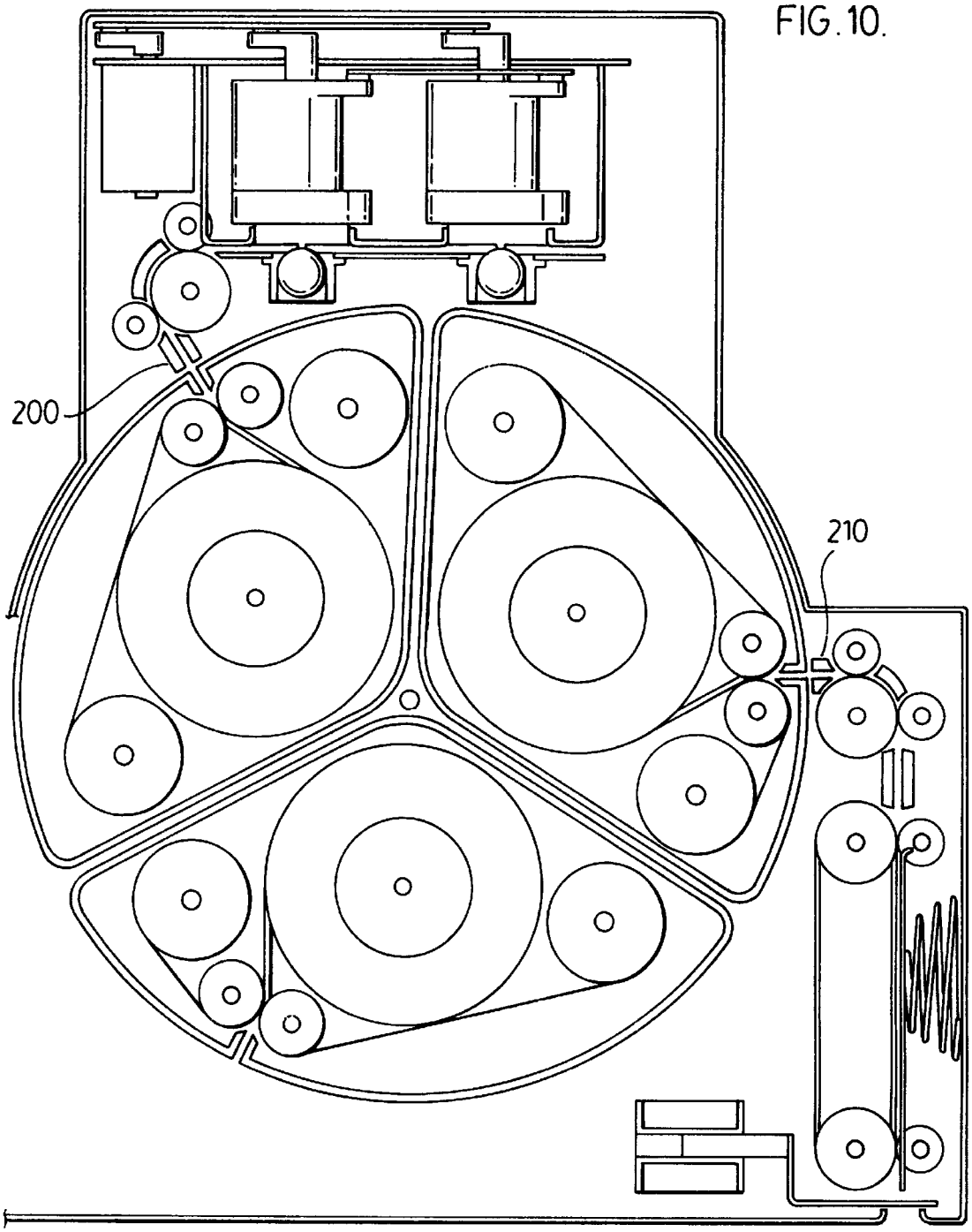
FIG. 10 is a top view of a modified arrangement.

FIG. 10 shows a modification of a banknote stacker. In this case, three banknote accumulating devices have been mounted on a rotary carousel for selective registration with an inlet 200. Banknotes to be accumulated are passed through the inlet 200 to the individual accumulators. In this case, there are three accumulators shown and as such, three separate denominations can be accumulated. The accumulating arrangement 67*a* is off to one side and has its own inlet 210. With this arrangement, the rotary carousel can be rotated for proper association with the inlet 200 or the inlet 210. With this arrangement, three different denominations can be separately accumulated in the three different accumulators and the dispensing of bills can be the combination of any of the three stored denominations.

The validator of FIG. 1 also shows a slot 200 for receiving a bankcard. In this case, the device can obtain bankcard authorization for payment of goods associated with the device, or to receive cash from the device. It can also be appreciated that the validator could accept banknotes and credit the accepted banknotes to the bankcard.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A device for validating and accepting paper currency comprising a validator that evaluates selected properties of the paper currency and determines whether the paper currency should be accepted or rejected and ejects the paper currency from the validator if the paper currency is rejected, a processing junction into which an accepted paper currency is fed, said processing junction including at least three processing paths including a first and second paths for accumulating paper currency for later dispensing of the paper currency and a third path for storage of accepted paper currency, and a drive arrangement associated with said processing junction for selectively driving an accepted paper currency along any of said paths; said device further including an accumulator and dispensing unit associated with each of said first and second paths, said accumulator and dispensing units having a common dispensing outlet through which accumulated paper currency is dispensed, and wherein said common dispensing outlet accumulates bills to be dispensed and dispenses accumulated bills as a stack of bills.

2. A device as claimed in claim 1 wherein said processing junction longitudinally receives accepted paper currency and said first and second paths for accumulating paper currency move said paper currency in a direction transverse to the longitudinal direction of accepted paper currency.

3. A device as claimed in claim 2 wherein said third path moves said currency in a direction parallel to the longitudinal direction of the accepted paper currency and stores the currency in a removable stacking arrangement.

4. A device as claimed in claim 3 wherein said third processing path is located on a side of said processing junction opposite an inlet path to said processing junction.

5. A device as claimed in claim 1 wherein said processing junction includes a drive arrangement which is movable for selective dispensing along any of said three paths.

6. A device as claimed in claim 5 wherein said drive arrangement includes drive rollers on either side of a longitudinal centerline of said processing junction which are rotatable from a first orientation for moving a bill longitudinally in said junction to a second orientation for moving said bill transversely in said junction along either of said first and said second paths.

7. A device as claimed in claim 1 wherein each dispensing arrangement serially receives said paper currency and winds said paper currency traversely onto a cylinder drum and each drum includes flexible separating tapes located either side of a received paper currency with said tapes also being wound on said respective drum.

8. A device as claimed in claim 7 wherein said tapes are spaced on said respective drum to be non overlapping with adjacent tapes.

9. A device for storing paper currency comprising a processing junction into which an accepted paper currency is fed by a feed drive arrangement, said processing junction including at least three processing paths including a first and second paths for accumulating paper currency for later dispensing of the paper currency and a third path for storage of accepted paper currency, and a drive arrangement associated with said processing junction for selectively driving an accepted paper currency along any of said paths and wherein said drive arrangement of said processing includes at least two drive wheels spaced either side of a longitudinal axis of said junction, said drive wheels being movable for moving paper currency received in said junction along any of said three paths.

10. A device as claimed in claim 9 wherein said processing junction longitudinally receives accepted paper currency and said first and second paths for accumulating paper currency move said paper currency in a direction transverse to the longitudinal direction of accepted paper currency.

11. A device as claimed in claim 10 wherein said third path moves said currency in a direction parallel to the longitudinal direction of the accepted paper currency and stores the currency in a removable stacking cassette.

12. A device as claimed in claim 11 wherein each of said first and second paths include a winding device for storing paper currency and dispensing of previously stored paper currency; each winding device comprising a driven winding drum adapted for rotation in a first direction to wind received paper currency on said drum and rotatable in the opposite direction for dispensing of a previously stored paper currency through a dispensing outlet, at least two separating tapes applied to opposite sides of stored paper currency with each tape being attached to said winding drum for winding therewith, a winding spool for each tape with a drive arrangement associated with said winding spools for driving said spools and winding said respective tape thereon during rotation of said winding drum in said direction to dispense a previously stored paper currency, a drive arrangement for transporting paper currency to or away from said winding drum, and a tape guide for each tape to apply said tapes to opposite sides of a received paper currency and to strip a received paper currency from said winding drum during dispensing of previously received paper currency.

13. A device as claimed in claim 12 including a paper currency validator for receiving and authenticating paper currency and said feed drive is associated with said validator and feeds authenticated paper currency to said processing junction.

14. A device as claimed in claim 9 wherein said at least two drive wheels include a first pair of drive wheels spaced either side of a longitudinal axis of said junction and to one side of a lateral axis of said junction and a second pair of drive wheels spaced either side of said longitudinal axis and to a side of said lateral axis opposite to the first pair of drive wheels, said drive wheels being movable for driving paper currency received in said junction along any of said three paths by appropriate rotation of said drive wheels.

15. A device as claimed in claim 9 including a paper currency storage and dispensing arrangement associated with said first and second paths, said paper currency storage and dispensing arrangement comprising at least four winding devices selectively movable for cooperation with said first and second paths, whereby each path can cooperate to store received paper currency in at least two winding devices.

16. A device as claimed in claim 15 including a card reader and processing arrangement for authorizing payment of goods associated with said device or receiving credit for banknotes received by said device.

* * * * *